US007654391B2

(12) United States Patent
Langer et al.

(10) Patent No.: US 7,654,391 B2
(45) Date of Patent: Feb. 2, 2010

(54) READILY CONFIGURABLE PLASTIC FOAM PACKAGING

(75) Inventors: Herbert Langer, Bedford, NH (US); Darrel Baker, Keene, NH (US)

(73) Assignee: Langer Associates, Inc., Manchester, NH (US)

( * ) Notice: Subject to any disclaimer, the term of this patent is extended or adjusted under 35 U.S.C. 154(b) by 360 days.

(21) Appl. No.: 11/423,176

(22) Filed: Jun. 9, 2006

(65) Prior Publication Data

US 2006/0278555 A1 Dec. 14, 2006

Related U.S. Application Data

(60) Provisional application No. 60/688,952, filed on Jun. 9, 2005.

(51) Int. Cl.
*B65D 81/02* (2006.01)
*B65D 85/00* (2006.01)

(52) U.S. Cl. ..... 206/523; 206/586; 206/521.1

(58) Field of Classification Search ..... 206/523, 206/586, 521; 83/13; 428/304.4; 333/523
See application file for complete search history.

(56) References Cited

U.S. PATENT DOCUMENTS 3,166,227 A * 1/1965 Ragnow ..... 206/523
3,334,798 A * 8/1967 Pezely, Jr. et al. ..... 206/594
3,564,811 A * 2/1971 Freeman ..... 53/474
3,580,469 A * 5/1971 Reese ..... 206/521
3,607,531 A * 9/1971 Small et al. ..... 156/251
3,655,112 A * 4/1972 Jeffers ..... 206/586
3,695,421 A * 10/1972 Wood ..... 206/523
4,267,927 A 5/1981 English, Jr.
4,414,735 A 11/1983 Buisson
4,496,627 A 1/1985 Azuma et al.
4,538,787 A * 9/1985 Fox et al. ..... 249/112
4,550,547 A 11/1985 Wagner, Sr.
4,603,445 A 8/1986 Spann
4,621,022 A 11/1986 Kohaut et al.
5,024,328 A 6/1991 Bontrager
5,028,470 A 7/1991 Reichenecker
5,207,327 A 5/1993 Brondos (Continued)

OTHER PUBLICATIONS

Sealed Air Corporation: Polythylene Fabrication Foams, CelluPlank®, Stratocell®, Stratocell® Plus and CelluCushion®; "High Performance Foam Plank, Thick Laminates and Special Density Sheets". Polyolefin Foam Division, 301 Mayhill Street, Saddle Brook, NJ 07663-5303, Tel: (800) 648-9093, Fax: (201) 712-7070. www.sealedair.com. D-101 Revised Jun. 2002. 8 pgs.

(Continued)

*Primary Examiner*—Mickey Yu
*Assistant Examiner*—Chun Cheung
(74) *Attorney, Agent, or Firm*—Grossman, Tucker, Perreault & Pfleger, PLLC

(57) ABSTRACT

An efficient means for providing packaging materials comprises foam sheets which have been at least partially cut into regular segments which may be configured by hand into nearly any shape to fit a void space which may surround an article to be packaged in a container. The sheets may be stacked into a cube for ease of transport and storage. The foam sheets may be easily separated into segments by hand by snapping (rigid) or tearing (flexible) the foam into a custom shape which best fits the void space. In one particular embodiment, the segments may comprise a thermoplastic foam which may be configured into corner pads for supporting an article within an outer container.

12 Claims, 4 Drawing Sheets

U.S. PATENT DOCUMENTS

| | | | | |
|---|---|---|---|---|
| 5,267,651 | A | 12/1993 | Hughes | |
| 5,477,573 | A | 12/1995 | Bonaddio et al. | |
| 5,511,667 | A * | 4/1996 | Carder | 206/586 |
| 5,534,208 | A | 7/1996 | Barr et al. | |
| 5,666,682 | A | 9/1997 | Bonaddio et al. | |
| 5,674,344 | A | 10/1997 | Thompson et al. | |
| 5,688,538 | A | 11/1997 | Barr et al. | |
| 5,876,813 | A | 3/1999 | Bambara et al. | |
| 5,947,293 | A | 9/1999 | Burchard | |
| 5,992,633 | A | 11/1999 | Burchard | |
| 6,167,790 | B1 * | 1/2001 | Bambara et al. | 83/13 |
| 6,305,539 | B1 | 10/2001 | Sanders, Jr. | |
| 6,508,362 | B2 | 1/2003 | Hnatow et al. | |
| 2003/0218278 | A1 * | 11/2003 | Tait et al. | 264/400 |

OTHER PUBLICATIONS

Leggett & Platt: "L&P-Newburyport, 1240CH Cushion Curve @ 36 " Drop Height". Date of printout May 18, 2005. 1 pg.

Alpha Packaging Solutions. "All-Fit™ Laptop/Notebook Shipper, US Patent No. 6,305,539 and other patents pending". www.alpha-pkg.com/lap_main.htm. Date of printout May 5, 2005. 1 pg.

Packez Shipping Boxes. "PackEZ™ All-In-One Packaging System". www.pakez.com/main.html. Date of printout May 11, 2005. 2 pgs.

Sealed Air Corporation; Stratocell Polyethylene Fabrication Foams-Sealed Air North America; "Stratocell® Laminated Polyethylene Foam Plank". www.sealedair.com/products/protective/pe_foam/stratocell.html. Date of printout May 17, 2005. 2 pgs.

Pactiv Corporation; Pactiv Advanced Packaging Solutions; "Propafoam® Polypropylene Foam". www.pactiv.com/Products_NA/ProtectivePackaging/EngineeredFoam/PropaFoamHD.aspx. Date of printout May 31, 2006. 1 pg.

Pactiv Corporation; Pactiv Advanced Packaging Solutions; "PolyPlank® LAM Laminated Plank"; www.pactiv.com/Products_NA/ProtectivePackaging/EngineeredFoam/PolyPlankLAM.aspx. Date of printout May 31, 2006. 1 pg.

* cited by examiner

READILY CONFIGURABLE PLASTIC FOAM PACKAGING

CROSS REFERENCE TO RELATED APPLICATIONS

The present application claims the benefit of the filing date of U.S. Provisional Application Ser. No. 60/688,952 filed Jun. 9, 2005, the teachings of which are incorporated herein by reference.

FIELD OF INVENTION

The present invention relates to packaging materials for protecting articles during transportation or storage. More particularly, the invention relates to sheets of plastic foam which may be readily configured by hand into shapes to customize the packaging of an article.

BACKGROUND OF THE INVENTION

Various types of packaging materials are known for packaging and shipping perishable or fragile articles. In some cases a box containing an article is suspended within another package or box for protection during shipping or storage. Loose fill packaging materials may be used to space and protect the inner articles within an outer box.

Of particular interest is the efficient packaging of fragile devices or articles such that vibration and shock due to impact do not harm the device or article. This is particularly true of electronic devices, medical devices, glassware, etc. Shipping and transport of smaller articles has resulted in the formation of an industry dedicated to serving the public in this area. For instance, the United Parcel Service, Federal Express and the United States Postal Service have all evolved to fill this need.

Particularly popular is the use of "loose fill" materials such as expanded plastic beads (polystyrene, polyethylene, polypropylene, etc.) which may be extruded and cut into a variety of shapes (peanuts, H-shaped, S-shaped, V-shaped, star-shaped, saddle-shaped, FIG. 8-shaped, etc.) which can be used to fill a void and surround an article placed inside a shipping container or box to cushion the article against damage. The loose fill provides a low weight "resilient envelope", however, it has been found that heavier articles may wander or settle within the loose fill medium over time due to vibration during transportation. While loose fill materials may have "good pourability" for filling a void or space between an article and its container, they are particularly difficult to dispose of, as the low density and high volume provide tremendous quantities of loose beads which the consumer must deal with and which many waste management companies do not see as "recyclable". A further disadvantage of loose fill materials is that the low density and large volume make storing and transporting the materials before use very inefficient. Other "loose-fill" materials may comprise shredded fiber board or paper, however these materials tend to settle or become compressed and are not as resilient as the aforementioned plastic foams.

Foam-in-place materials provide another option to package articles. Thermoset two-component urethane precursors may be reacted together and poured or sprayed to expand and fill an open space to provide cushioning.

Thermoplastic beads may be expanded in shaped molds to form customized sections of packaging for the protection of contents. Often these are used as "clam shell" protectors on each end of an article to "suspend" the article in a packaging container. These materials, once formed to shape, are specific to an application or shaped article and are not readily reusable for packaging other articles, particularly of other shapes. In addition, these molded sections are bulky to transport and store before use. Further, these materials are particularly difficult to dispose of due to their odd or complex shapes. In attempting to efficiently dispose of these odd shapes, the shapes are often broken into pieces causing a lot of loose dust or "fluff".

An alternate means to provide packing materials has been to cut a block or sheet of, for instance, a foamed material to shape. That is, however an extremely wasteful process as a lot of scrap is generated from the material that is removed from the blank and usually a lot of dust or debris is generated.

"Bubble-wrap" is another type of packaging for articles, where a sheet of plastic bubbles can be wrapped around an article having a regular shape. However, the ability of "bubble-wrap" to fill irregular shaped spaces or voids is poor and, once again, disposal is difficult, unless one wants to crush all the bubbles to reduce the volume to a practical level.

In the packaging of heavy products, appliances and the like, corner and top support pads may be provided between a corner of the appliance and an outer container. These pads provide impact protection as well as stacking strength. Often these support pads are formed to shape of paper board and adhesive. They are not however generally reusable in a different configuration.

What is needed is a product which provides an easily configurable shape that may be customized to efficiently package a given article and which may be readily reusable and more easily disposed of.

SUMMARY OF THE INVENTION

It is thus an object of the present invention to provide packaging materials, particularly void fillers, which are supplied efficiently in sheet form and which may be readily separated and configured into shapes which closely match the void or areas being filled.

According to this invention, the objective is obtained by providing foamed plastic sheets which have been partially cut through in a regular pattern such that segments may be readily separated by hand to substantially conform the packaging to the space to be filled. This provides for the efficient use of packaging materials both in their supply chain and in use. Once used, the sections may be reconfigured for another application or may be disposed of efficiently and cleanly.

In a first embodiment, the invention is directed at a sheet of rigid, preferably polystyrene, foam which has been cut nearly through its thickness in a regular pattern such that the sheet may be fractured along the cut line into shapes to closely fit a packaging space. Additionally, the bottom of the cut line is radiused to prevent the creation of dust when the segments are separated.

In a second embodiment, the invention is directed at sheets of flexible, preferably polyurethane, foam which has been convoluted. The sheets are die cut into regular segments, however, small connecting tab sections remain uncut around the periphery of each segment to provide a sheet that is efficient to handle, yet easily separated by hand into custom shapes.

In a third embodiment, the invention is directed at a preferably laminated sheet of low density thermoplastic foam. The sheet may be die cut in an intermittent pattern to form a three-segmented L-shaped section which may be hinged around uncut portions to form three-dimensional corner pieces for rectangular objects packed within another box or carton. The corner pieces may provide spacing as well as impact protection and are reusable.

BRIEF DESCRIPTION OF THE DRAWINGS

These and other objects, features and advantages of the present invention will become apparent to those skilled in the art upon reference to the following written description of exemplary embodiments, which description should be considered in conjunction with the accompanying drawings, wherein.

DETAILED DESCRIPTION OF THE INVENTION

The present invention is described more fully hereinafter with reference to the accompanying drawings, in which preferred embodiments of the invention are shown. This invention, may, however, be embodied in many different forms and should not be construed as limited to the embodiments set forth herein; rather, these embodiments are provided so that this disclosure will be thorough and complete, and will fully convey the scope of the invention to those skilled in the art.

The present invention is directed at the efficient use of packaging materials for protecting articles during storage or transport. The packaging materials, which may be of various hardnesses, densities, impact strengths and resiliencies, may be supplied in sheet form preferably stacked in a space efficient cube. The sheets may be partially cut into standard size segments that may be separated into shapes by hand which may closely match the void space between an article and its shipping or storage container to efficiently protect the article against damage. Since the sheets may be pre-scored into regular shaped segments, the segments may be reused in other packaging applications by further separating or re-combining the segments. Disposal efficiency is improved since the regular shaped segments are not so small, like loose fill materials, to take up large volumes or create dust, yet the segments are small enough, preferably 1 to 3 inches wide by 1 to 3 inches long, to be contained in a small space.

Figure 1:
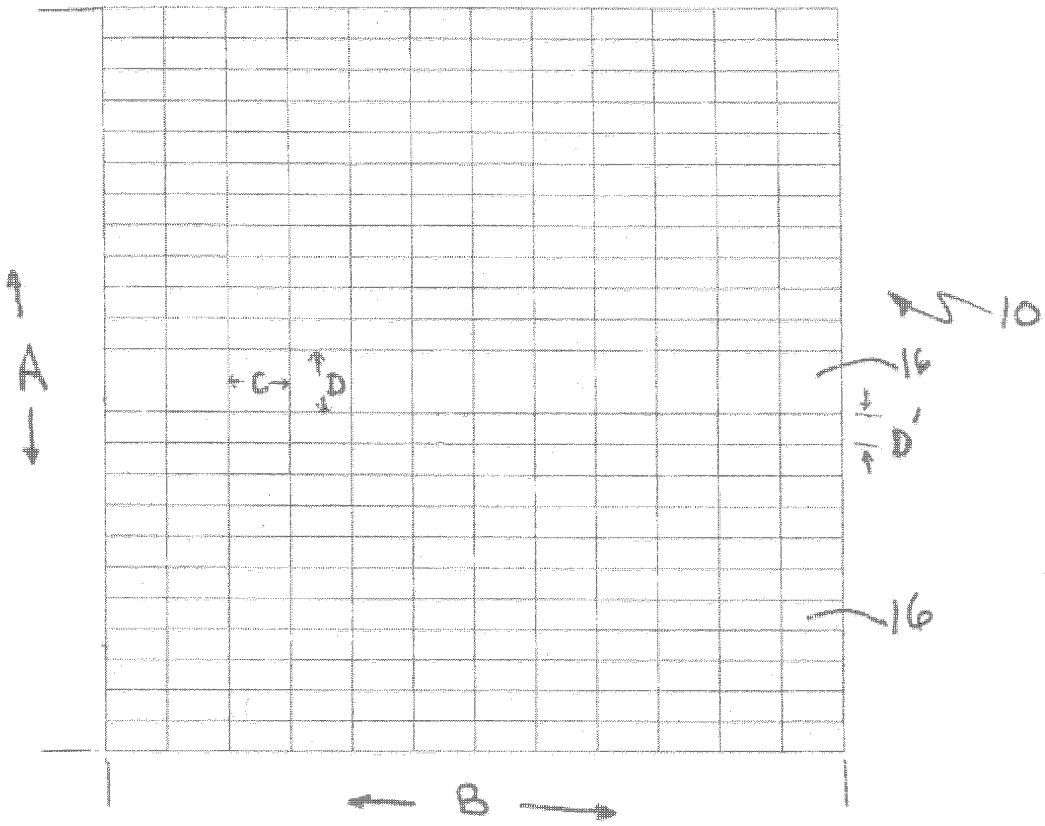
FIG. 1 illustrates a plan view of a first embodiment according to the present invention.

FIG. 1 is a plan view of a first embodiment of the readily configurable foam packaging according to the present invention. A rigid foamed plastic foam sheet 10 is shown which preferably may have dimensions of about 24 inches (A) by 24 inches (B) by about 1 inch thick.

The foam may preferably comprise polystyrene foam of about 1.0 pounds per cubic foot density, but may be any rigid or semi-rigid foam composition of any density suitable for packaging articles to protect them in storage or in transport. For instance, the foam may comprise, but not be limited to, polystyrene, polyolefin, epoxy and polyurethane, and blends, alloys and copolymers thereof. For efficient packaging, the density range may comprise, but not be limited to, about 0.4 to about 10 pounds per cubic foot. Since packaging should not contribute substantially to the weight of the article being shipped, densities in the range of about 0.4 to about 2.0 pounds per cubic foot may be preferred, providing they furnish sufficient protection.

The rigid plastic foamed sheet 10 may be manufactured by the expansion of beads as is known in the art, or in the case of rigid urethane or epoxy, may be a poured in place, reacted thermoset composition.

To provide an efficiently sized segment, readily configurable into various shapes for filling void spaces around articles in a container, the sheet 10 may be segmented into regular shaped preferably rectangular segments 16 each preferably having a width of about 1 inch to 2 inches (C) by a length of about 1 inch to 2 inches (D). A sheet 10 may comprise a mixture of sizes as shown in FIG. 1 where C×D may be 2 inches by 2 inches and C×D' having dimensions of 2 inches by 1 inch.

The foam sheet 10 may be only partially cut through using, preferably, a heated wire to provide the segments 16 which may be easily separated by hand, but still retain the sheet 10 in an space efficient single piece which may be stacked into a cube for shipping and storage of the packaging material. While rectangular shaped segments are preferred for ease of handling, the segments may comprise any shape, including but not limited to, triangular, octagonal, hexagonal, pentagonal, rhomboid, curved or combinations thereof.

Figure 2:
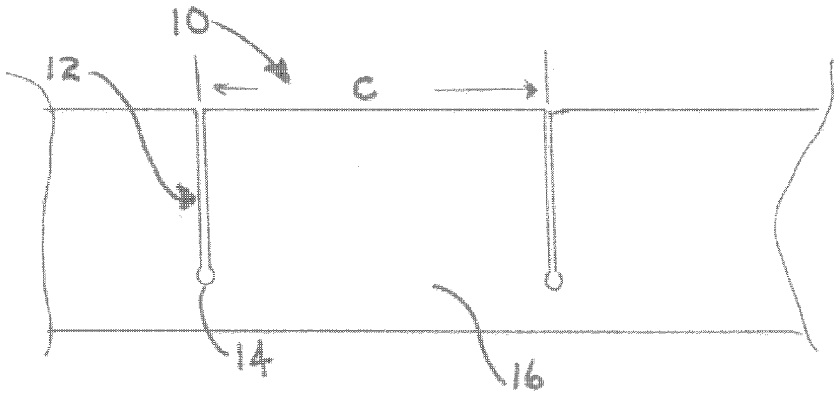
FIG. 2 is an enlarged side view of the embodiment illustrated in FIG. 1.

FIG. 2 is an enlarged side view of the foam sheet 10 illustrating how the segments 16 are formed.

In one preferred embodiment a heated nickel-chromium wire may be held tautly and pressed into the sheet 10 to about three-quarters of the thickness of the sheet. The wire may be preferably about 0.014 inches in diameter and heated by applying a voltage of about 15 volts to generate the heat. Pressing the hot wire into the sheet 10 may melt the foam to form a narrow slit 12.

Figure 5:
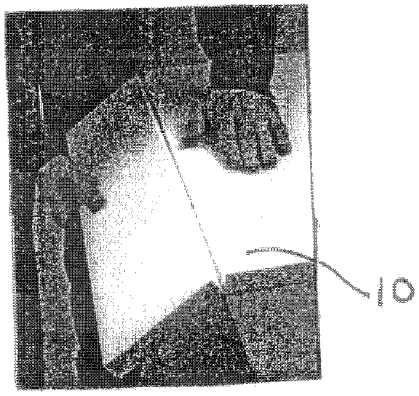
FIG. 5 is a perspective view illustrating the separation into segments of the first embodiment illustrated in FIG. 1.

As further shown in FIG. 2, the wire preferably may form a slit only part way through the thickness of the sheet to allow the sheet to be easily handled as a single article after being slit. The preferably rectangular segments 16 thus formed may then be separated by hand into whatever shape most closely resembles the void space to be filled around an article to be supported inside a container. For instance, the segments may form an end cap for each article to be packaged by removing the center portion of the sheet (forming a clam shell package). Or the segments may be broken apart to form an "L" shape such as for the corner of a rectangular article. The segments may be readily broken apart by hand as shown in FIG. 5 by bending the sheet along one of the slits 12 over a sharp edge such as a table or counter.

To ensure a clean break without the creation of dust or debris, the slit 12 formed in the sheet 10 may terminate at a smooth radius 14 formed at the bottom of the slit. This may be accomplished by having a dwell period in the slitting process, letting the hot wire pause momentarily at the bottom of the slit to form a preferably, smooth sided nearly circular region around the wire. The additional melting of the foam in this area preferably may form a semi-circle of about 0.060 inches in diameter using a dwell time of about 0.5 seconds with the aforementioned process parameters. Preferably the semi-circle 14 may be located at about 75 percent to about 85 percent of the thickness of the sheet.

Thus, the rigid foam sheet 10 may provide an efficiently packaged packaging material which may protect and cushion articles without adding weight and may easily be configured to a desired size and shape by hand without the need to cut the foam or create a mess. Further, the material may provide insulation (R value of 4.0 per inch), if needed. With the segmented sheet there may be essentially no waste as every segment may be used in some packaging application and more often than not may be reused by further separating or re-combining the segments into a new shape which fills the void between an article and its container.

In a second embodiment, the foam packaging material may be a flexible foam, preferably a polyurethane, of around 1.0 pounds per cubic foot density. This softer flexible foam may be more suitable for packaging fragile or odd-shaped articles. As with the rigid foam of the first embodiment, the flexible foam may likewise be supplied for efficient storage and transport in a 24 inch (A) by 24 inch (B) sheet (see FIG. 3), preferably stacked in a cube.

Figure 3:
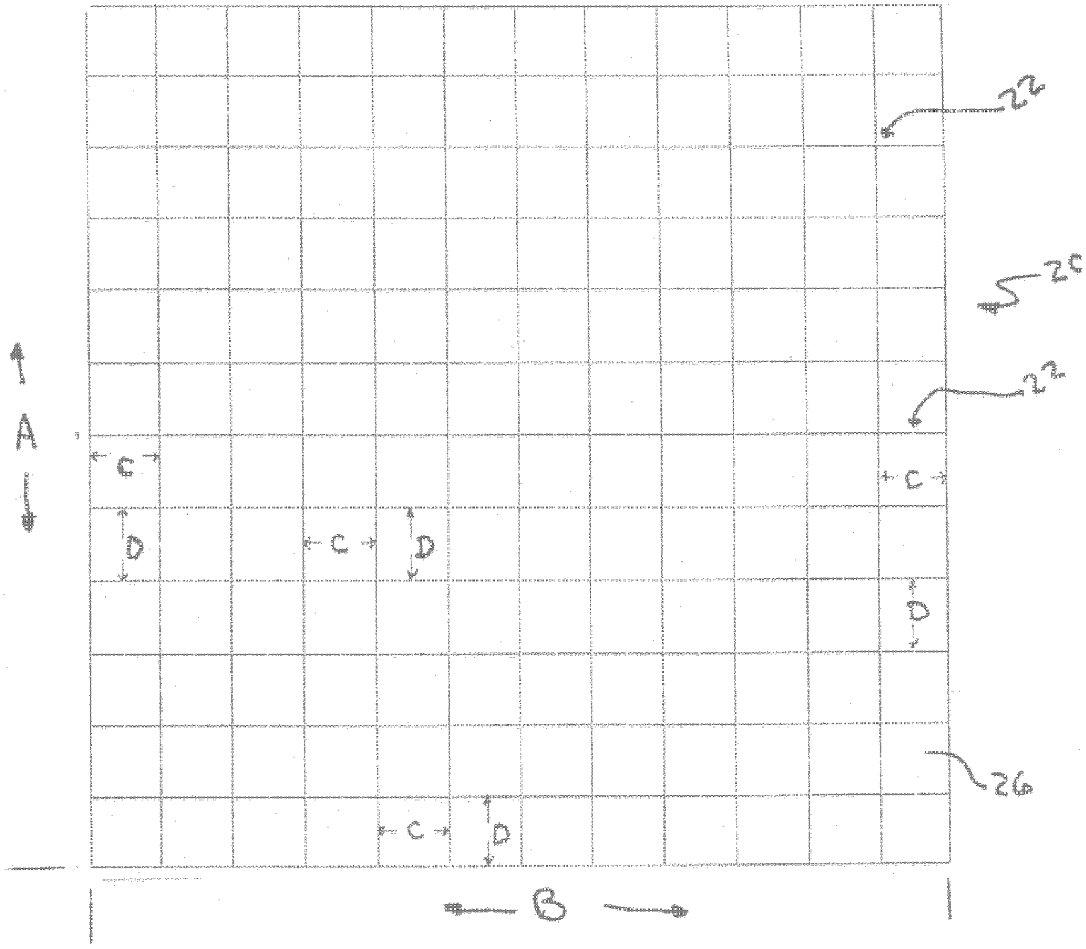
FIG. 3 illustrates a plan view of a second embodiment according to the present invention.

FIG. 3 shows a plan view of the flexible foam sheet 20. The sheet 20 may be preferably die cut into 2 inch (C) by 2 inch (D) segments which have uncut sections or tabs 22 at the corners and at the center of each edge to retain the segments 26 in sheet form until they are used. At that point, the segments 26 may easily be torn apart by hand to form whatever shape or configuration fits the void space between an article to be protected and its container.

Figure 6:
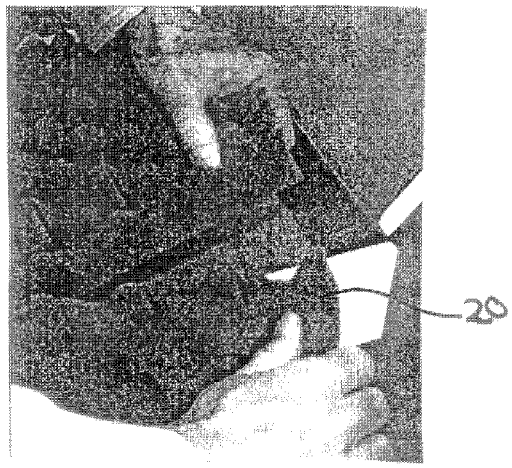
FIG. 6 is a perspective view illustrating the separation into segments of the second embodiment illustrated in FIG. 3.

The separation process is shown in FIG. 6. As with the first embodiment of the present invention, the segments 26 may be separated to form shapes ("L", "H", "I", "T", for instance) or even hollow shapes with the center removed for use as end caps in clam shell packaging.

To form the segmented sheet which comprises the second embodiment of the present invention, a sheet of flexible foam may be provided by skiving a bun to shape or pouring-in-place a shape as is known in the art. The foam may preferably be of low density, in a range of about 0.5 pounds per cubic foot to about 10 pounds per square foot, more preferably of about 0.8 pounds per cubic foot to about 1.8 pounds per cubic foot. The sheet 20 may preferably be about 2 inches thick and have an ILD (Indentation Load Deflection) of about 32 to about 40 pounds according to ASTM test method number (D3574-86, 25% deflection).

Figure 4:
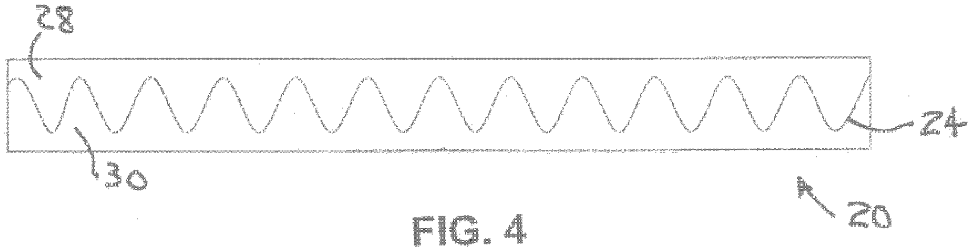
FIG. 4 is a side view of the embodiment illustrated in FIG. 3.

The foam sheet may preferably be convoluted as in known in the art to form a surface of matching protrusions and depressions which may be separated into two matching sections. This is shown in FIG. 4 with the cut line between the foam sections 28, 30 shown as reference numeral 24.

Such convoluted sections may comprise a dimpled surface on one side of the foam section, such dimpled surface being formed by passing a flat sheet through a convoluting machine which has a pair of rolls with opposed spaced projecting members arranged in a pattern, and while the sheet is compressed between the rollers, subjecting the sheet to the action of a transverse saw, splitting the sheet to form a pair of convoluted sections each having the dimpled surface on one side. The dimpled surface in cross-section may thus be formed in a generally sinuous configuration.

While shown as sinusoidal in shape (FIG. 4), the pattern generated in the matching surface of the foam sheet sections may vary widely according to the pattern which forms the outer surface of the rolls of the convoluter which feeds the foam to the splitter. Shapes that may form the peaks and troughs (projections and depressions) include, but are not limited to; square, hexagonal, octagonal, round and oval.

The foam sheet preferably may comprise a thermoset urethane having a polyether, polyester or graft copolymer polyol component, although other expanded polymers which may be easily compressed are also contemplated.

To create a sheet of segments 26 which are easily separated and configurable to form a void space, the foam sheet 20 after being convoluted, as shown in FIG. 4, may be die cut into preferably 2 inch by 2 inch segments 26 using preferably a steel rule die. Other methods such as laser cutting or water jet trimming are also contemplated.

Figure 7:
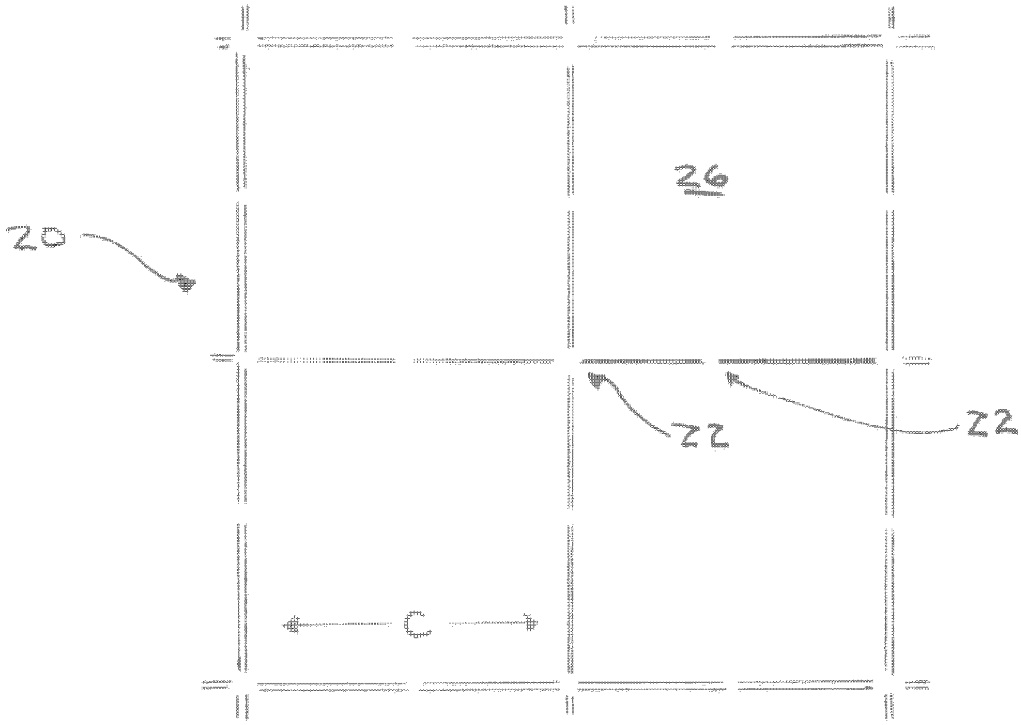
FIG. 7 is a view of the surface of the second embodiment illustrated in FIG. 3.

FIG. 7 illustrates an essentially full size view of a portion of the outer surface of the foam sheet 20 of FIG. 3. The steel die may be pressed into the foam to sever the sheet into segments but leave connecting tab portions 22, preferably at the corners and the center of each edge of each segment 26.

The connecting tabs may be preferably formed by having a segmented die which allows a portion of the sheet to be cut through, while other portions are not cut, as the matching portion of the die has been removed in that area. The connecting tabs 22 may be preferably about 0.060 inches in width and may extend through the thickness of the sheet 20 for a distance of from about 0.060 inches thick to the full thickness of the sheet (about 2 inches). Thus, the flexible foam sheet 20 may provide an efficiently packaged packaging material which may protect and cushion articles without adding weight and may easily be customized to a desired size and shape without the need for knives to cut the foam or creating debris. There may be no waste as every segment may be used in some packing application and most can be used by further separating or recombining the segments into a new shape which fills the void between an article and its container.

In a third embodiment, the foam packaging material may be a relatively flexible thermoplastic such as polyethylene, polypropylene, other polyolefins and blends, alloys and copolymers with polystyrene. The foam may be cross-linked by radiation, graft initiator, cross-linking agent, etc. The thermoplastic foam may be provided by extruding a sheet of about 0.5 inches in thickness. Preferably, the foam has a density in the range of about 0.5 pounds per cubic foot to about 10 pounds per cubic foot, more preferably about 1.2 pounds per cubic foot. This sheet may then be heat laminated to other like sheets to form a sheet or "plank" of preferably about 1.0 inches to about 3.0 inches in thickness. The sheets may be laminated together using hot air (about 1000° F.) applied to facing surfaces and then compressing the sheets together through the nip of a set of rollers, bonding the heating surfaces together upon cooling. Replication of this process may build the sheet thickness to the desired end use thickness.

Generally when packaging an article within a container, a thickness of about 2 inches of protective packaging between the article and container is recommended. This provides cushioning as well as some protection from penetration. For heavy articles, especially those having defined corners, such as appliances, furniture, etc., corner pads may be configured from the aforementioned laminated sheets or planks of thermoplastic foam to yield a dent resistant, somewhat resilient, cushioning segment having a reasonably high level of stiffness. This material may fill the need between a relatively rigid non-conformable packaging material, like polystyrene foam and the like, and a relatively soft configurable packaging material, like flexible polyurethane foam, and the like.

Thermoplastic foams as used in this third embodiment may generally be closed celled, useful over a wide range of temperatures, with excellent tensile and tear strength and not easily abraded. The resilient, closed cell structure may effectively absorb shock and vibration and recover the foam to its original shape if deflected.

Figure 8:
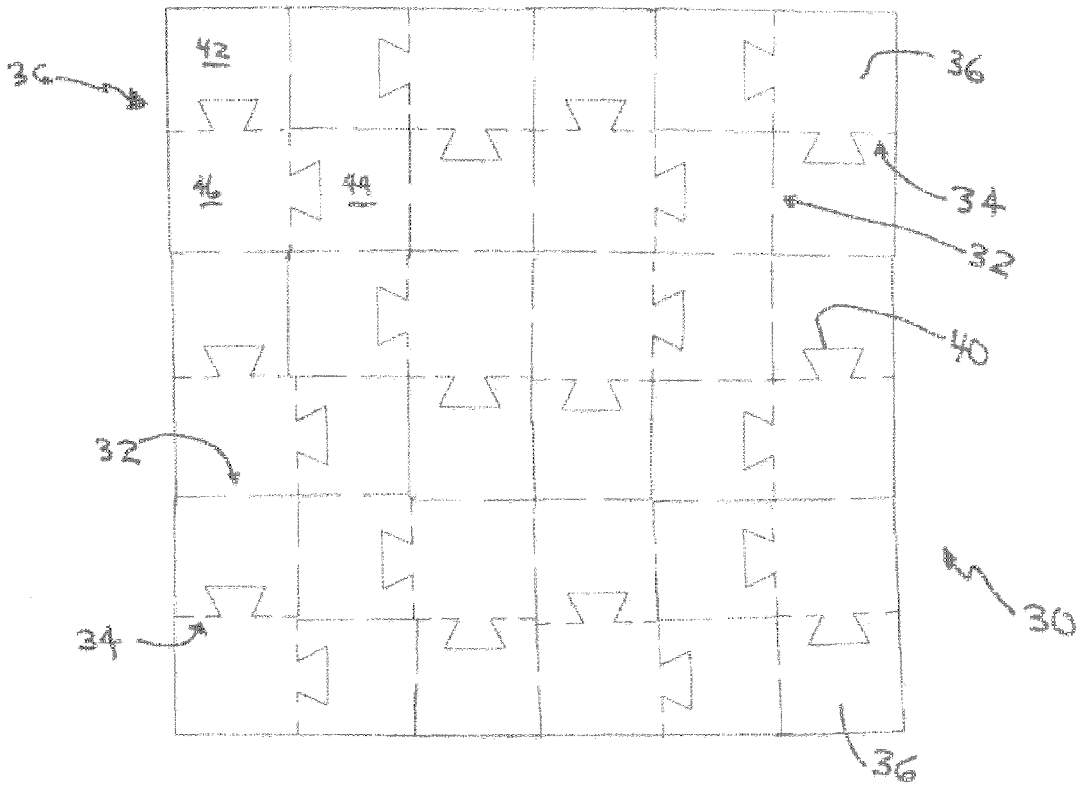
FIG. 8 illustrates a plan view of a third embodiment according to the present invention.

FIG. 8 is a plan view of a sheet or plank of thermoplastic foam, as described above, laminated to about 2.0 inches in thickness.

The plank 30 may preferably be supplied in sections of about 18 inches wide by 18 inches long, or multiples thereof such that the section may be die cut into sub-segments of about 3 inches by 3 inches. These 3 inch square sub-segments may then be separated from the plank 30 as an L-shaped segment 36 (see FIG. 9A) which may be configured into a corner pad (or cap or support) 38 as shown in FIG. 9B.

The specifics of forming the L-shape segments 36 from the plank 30 are as follows. A steel rule die may be used to "kiss cut" through the plank 30, shown in FIG. 8, leaving selected portions of the sheet connected together locally to allow ease of handling the L-shaped sections 36. The die may cut completely through the sheet at selected locations as indicated by the solid lines in FIG. 8, but leave a portion of the thickness of the plank 30 uncut (due to sections missing in the die blade) along common edges of interlocking L-shaped segments. These uncut tab sections are indicated by reference numeral 32 in FIGS. 8 and 9A).

These tabs 32, which may generally be about 0.060 inches in width by 0.060 inches in thickness, may allow the sheet or plank to be handled as a single article and be stacked into a cube for efficient storage and shipment of the packaging prior to its intended end use, yet provide easy separation of the L-shaped segments by tearing. The vestiges of these tabs may be seen in FIG. 9A along the periphery of the L-shaped segment 36 and referenced as numeral 32'.

When the L-shaped segment (36 in FIG. 9A) is needed to provide a corner pad for a packaging application, an L-shaped segment may be manually separated from the plank 30 (FIG. 8).

Figure 9A:
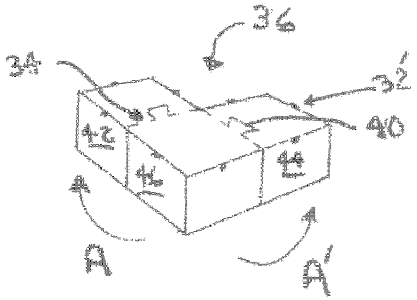
FIGS. 9A and 9B illustrate a segment separated (FIG. 9A) from the sheet of FIG. 8 and configured (FIG. 9B) into a corner pad according to the present invention.
Figure 9B:
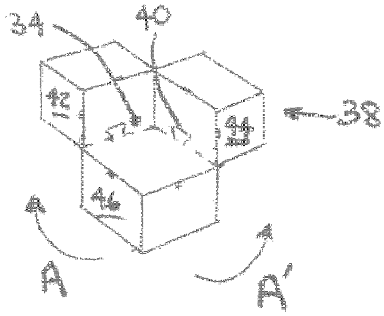

The L-shaped segment 36 (FIG. 9A) may then be configured into a corner pad by rotating each of the end sub-segments 42, 44 in the direction of arrows A and A' in FIG. 9A. This then may provide the corner pad 38 shown in FIG. 9B. Thus, a protective end cap having a thickness of about 1.5 inches to about 3 inches may be formed from 3 inch square sub-segments formed by partially die cutting the laminated plank section 30.

To ensure that the sub-segments 42 and 44 remain essentially perpendicular to the base sub-segment 46, a dovetail section 40 may be die cut into each of the sub-segments 42, 44. A connecting hinge portion 34 similar to tab 32 may be used to connect the sub- segments together and may be located on either side of the dovetail 40 to ensure that the sub-segments 42 and 46 and 44 and 46 remain connected and that each may be rotated to form a corner cap 38. Preferably the size of the hinge portion 34 is controlled, and preferably may be relatively wider and thicker than tear tab 32. By controlling of the width and thickness of the hinge portions 34, it is important to note that one can therefore control the angle that may be formed as between first sub-segment 42 and base 46 and between sub-segment 44 and base 46. For example, by reducing the width of the hinge portion 34 and/or its thickness, sub-segments 42 and 44 may be positioned and self-assemble to about a 90 degree angle with respect to base 46.

By reference to dovetail section it should be understood that this relates to any geometry that, when the sub-segments 42 or 44 are rotated to a substantially perpendicular configuration relative to base 46, such geometry is one that creates an interference as between base 46 and any one of sub-segments 42 or 44, so that they remain in a position for use in packaging as a corner pad.

When the sub-segments 42 and 44 are rotated in the direction of arrows A and A' (FIG. 9B) around hinge portions 34 relative to base 46, the dovetail sections 40 of base 46 may be rotated through the body of sub-segment 42 and 44 until the dovetail sections 40 clear the inner wall of the sub-segment. At this point the ears of the dovetail 40 may clear the side wall and recover their original shape to act as a locking mechanism to ensure that the corner pad 38 retains its desired, essentially inside square corner, configuration. In other words, that sub-segments 42 and 44 may not return to their original flat sheet orientation but may be retained by the dovetail sections 40 in a position substantially perpendicular to base 46. In one preferred embodiment the sub-segments 42, 44 and 46 were each about 3 inches square and 2 inches thick and the dovetail extended about 0.75 inches into the sub-segments 42, 44 and had a width about 1.5 inches across the ears and about 1.125 inches at its narrowest point. Retention of this "inside corner" shape for the pad may allow easy location of four corner pads in the bottom of a container with minimal adjustment. Another four pads may be located at the top corners of the article being packaged and covered by a container top.

All three embodiments of the present invention thus comprise a polymeric foam provided in sheet form which may be easily separated into segments to customize packaging for a multitude of applications.

The description and drawings illustratively set forth the presently preferred invention embodiments. We intend the description and drawings to describe the embodiments and not to limit the scope of the invention. Obviously, it is possible to modify these embodiments while remaining within the scope of the following claims. Therefore, within the scope of the claims one may practice the invention otherwise than as the description and drawings specifically show and describe.

What is claimed is:

1. A packaging product capable of being configured into a corner pad, comprising a plank of thermoplastic foam having a thickness, said plank including a plurality of sheets and an original shape, said plank of foam cut into a series of interlocking L-shaped segments, said interlocking L-shaped segments sharing a common edge, wherein said cut extend through the thickness of said plank, a portion of said cut terminating prior to the full thickness of the plank to form tab areas which connect said interlocking L-shaped segments together along their common edge, such that said plank retains its original shape after said L-shaped segments are formed, said L-shaped segments further cut into a first, a second and a base sub-segments wherein a portion of said cut between said sub-segments terminates prior to the full thickness of the plank to form hinge portions at uncut portions of said plank between said first sub-segment and said base and said second sub-segment and said base, wherein said cut further form a dovetail section in said first and said second sub-segments such that said dovetail sections clear said cut and lock said first and second sub-segments in a position substantially perpendicular to said base sub-segment to form said corner pad when said first and second sub-segments are rotated along said hinge portions around said base.

2. The packaging product of claim 1, wherein said sheet of foam comprises a thermoplastic.

3. The packaging product of claim 1, wherein said plank of foam comprises a lamination of sheets of foam.

4. The packaging product of claim 1, wherein said plank of foam has a density of between about 1.0 pounds per cubic foot and about 2.0 pounds per cubic foot.

5. The packaging product of claim 1, wherein said first and said second sub-segments are locked substantially perpendicular to said base.

6. A method of forming a corner pad for supporting an article within a container, the method comprising the steps of:

providing a sheet of thermoplastic foam having a thickness and an original shape;

cutting said sheet into a series of interlocking L-shaped segments, said interlocking L-shaped segments sharing a common edge, wherein said cuts extend through the thickness of said sheet;

forming tab areas along said common edge by locally terminating a portion of said cut prior to the full thickness of said sheet such that said sheet retains its original shape after said L-shaped segments are formed;

cutting said L-shaped segments into first, second and base sub-segments;

terminating a portion of said cut between sub-segments prior to the full thickness of said segments to form hinge portions between said first sub-segment and said base and between said second sub-segment and said base;

cutting a dovetail section in said first and said second sub-segments;

separating said L-shaped segment from said sheet;

rotating said first and said second sub-segments along said hinge portions relative to said base until said dovetail sections clear said cut; and locking said first and said second sub-segments substantially perpendicular to said base.

7. The method of claim 6, wherein said sheet of foam comprises a thermoplastic.

8. The method of claim 6, wherein said sheet of foam comprises a lamination of sheets of foam.

9. The method of claim 6, wherein said sheet of foam had a density of between about 1.0 pounds per cubic foot and about 2.0 pounds per cubic foot.

10. A L-shaped segment of foam comprising a plurality of sheets, said segment having a thickness and capable of being configured into a corner pad, comprising a first, a second and a base sub-segments, wherein said first and said base and said second and said base sub-segments are separated by a cut extending through the thickness of said L-shaped segment, a portion of said cut terminating prior to the full thickness of said segment to form hinge portions at uncut portions of said foam, and wherein said cut further form a dovetail section in said first and said second sub-segments such that said dovetail sections clear said cut and lock said first and second sub-segments in a position substantially perpendicular to said base sub-segment to form said corner pad when said first and second sub-segments are rotated along said hinge portions around said base.

11. The L-shaped segment of claim 10 wherein said first, second and base sub-segments are all substantially the same size.

12. The L-shaped segment of claim 10 wherein said hinge portion has a thickness and a width, and said thickness and width are selected so that said first and said second sub-segments self-configure to be substantially perpendicular to said base.

* * * * *